US008887499B2

(12) United States Patent
Edler et al.

(10) Patent No.: US 8,887,499 B2
(45) Date of Patent: Nov. 18, 2014

(54) ELECTRONIC HIGH HYDRAULIC PRESSURE CUTOFF TO IMPROVE SYSTEM EFFICIENCY

(75) Inventors: Brad Edler, Metamora, IL (US); Viral S. Mehta, Peoria, IL (US); Lawrence Tognetti, Peoria, IL (US); Christopher Williamson, Greendale, WI (US)

(73) Assignees: Caterpillar Inc., Peoria, IL (US); Purdue University, West Lafayette, IN (US)

( * ) Notice: Subject to any disclaimer, the term of this patent is extended or adjusted under 35 U.S.C. 154(b) by 683 days.

(21) Appl. No.: 13/172,320

(22) Filed: Jun. 29, 2011

(65) Prior Publication Data

US 2013/0000292 A1 Jan. 3, 2013

(51) Int. Cl.
*F16D 31/02* (2006.01)
*F15B 11/05* (2006.01)

(52) U.S. Cl.
CPC ..... *F15B 11/055* (2013.01); *F15B 2211/613* (2013.01); *F15B 2211/6346* (2013.01); *F15B 2211/27* (2013.01); *F15B 2211/20553* (2013.01); *F15B 2211/20576* (2013.01); *F15B 2211/7053* (2013.01); *F15B 2211/625* (2013.01)
USPC ..... 60/431; 60/452

(58) Field of Classification Search
USPC ..... 60/431, 452, 476
See application file for complete search history.

(56) References Cited

U.S. PATENT DOCUMENTS 5,201,177 A 4/1993 Kim
5,361,211 A 11/1994 Lee et al.
5,810,046 A 9/1998 Lee
7,530,225 B2 5/2009 Ikeda
7,543,449 B2 * 6/2009 Ivantysynova et al. ..... 60/464
2010/0162885 A1 * 7/2010 Hughes et al. ..... 91/361

OTHER PUBLICATIONS

Atos, "Digital Electronic Drivers type E-RI-PES", ATOS product brochure, retrieved from URL: http//www.atos.com/english/technical_tables/english/G215.pdf (Jul. 26, 2011).*

Zimmerman et al., "Hybrid DIsplacement Controlled Multi-Actuator Hydraulic Systems," The Twelfth Scandinavian International Conference on Fluid Power, May 18-20, 2011, Tampere, Finland.*

Heybroek, Kim, Saving Energy in Construction Machinery Using Displacement Control Hydraulics, Linkoping Studies in Science and Technology Thesis No. 1372, Linköping 2008.*

"Digital electronic drivers type E-RI-PES," ATOS product brochure, retreieved from URL: http://www.atos.com/english/technical_tables/english/G215.pdf (Jul. 26, 2011).

* cited by examiner

*Primary Examiner* — Edward Look
*Assistant Examiner* — Daniel Collins
(74) *Attorney, Agent, or Firm* — Leydig, Voit & Mayer, Ltd.

(57) ABSTRACT

A method for overpressure control in a hydraulic system having multiple hydraulic pumps, with each hydraulic pump being connected by a respective hydraulic circuit for actuating a single respective hydraulic actuator, includes actuating a first variable displacement hydraulic pump, the first hydraulic pump being fluidly linked by a first hydraulic circuit to a first hydraulic actuator for powering the first hydraulic actuator. Upon detecting a pressure that exceeds a predetermined threshold pressure, the flow rate of the first hydraulic pump is electronically modified to a second flow rate lower than the first flow rate whereby the pressure in the first hydraulic circuit is reduced to a pressure that is below the predetermined threshold pressure.

13 Claims, 5 Drawing Sheets

ELECTRONIC HIGH HYDRAULIC PRESSURE CUTOFF TO IMPROVE SYSTEM EFFICIENCY

TECHNICAL FIELD

This patent disclosure relates generally to a hydraulic circuit for a double acting piston and cylinder, and, more particularly to arrangements for hydraulic pressure cutoff in a system including a variable flow pump.

BACKGROUND

Unlike a typical hydraulic system having a single pump feeding a plurality of solenoid valves to control an associated plurality of functions, a "meterless" hydraulic control system controls each hydraulic actuator of each function by controlling a flow rate from a dedicated pump associated with that actuator. Thus, while proportional or throttling valves are utilized in prior art metered systems to meter fluid to control movement of each actuator, the flow to each actuator in a meterless system is controlled directly by controlling the associated pump. The dedicated pump or pumps may be of any suitable type including variable displacement or fixed displacement, wherein the flow from the pump to the actuator chambers is varied in order to control the speed and extent of the actuator movement.

In prior art meterless arrangements, pump controlled circuits known as Displacement Controls (DC) utilize a variable displacement pump with a constant speed driver, while Electro-Hydrostatic Actuators (EHA) utilize a fixed displacement pump with a variable speed driver. In either case, since actuator flow is controlled by the pump, the hydraulic circuit associated with one or more actuators may experience and overpressure condition when the associated actuated element encounters an obstruction. Typical practice is to provide a relief valve through which fluid is vented to relive the excess pressure. In this arrangement, whenever the set release pressure of the valve is reached, the valve opens and the pressure decreases. When the pressure has decreased to below the valve limit, the valve shuts again.

Although this type of system allows for pressure control, it does so at the expense of fuel efficiency and system. In particular, the release of hydraulic fluid to lower pressure wastes the energy stored in the fluid at that point.

SUMMARY

In one aspect of the disclosure, there is described a method for overpressure control in a hydraulic system having multiple hydraulic pumps. Each hydraulic pump is connected by a respective hydraulic circuit for actuating a single respective hydraulic actuator. The method includes actuating, at a first flow rate, a first variable displacement hydraulic pump of the multiple hydraulic pumps, the first hydraulic pump being fluidly linked by a first hydraulic circuit to a first hydraulic actuator for powering the first hydraulic actuator. After initially detecting a first pressure in the first hydraulic circuit, the first pressure being below a predetermined threshold pressure, the method entails detecting a second pressure in the first hydraulic circuit, the second pressure exceeding the predetermined threshold pressure. In response, the flow rate of the first hydraulic pump is electronically modified to a second flow rate lower than the first flow rate whereby the pressure in the first hydraulic circuit is reduced to a pressure that is below the predetermined threshold pressure.

In another embodiment, a hydraulic system is described having relief valve-less overpressure control. The hydraulic system includes first and second variable displacement hydraulic pumps, first and second hydraulic actuators, and respective first and second hydraulic circuits connecting the first and second variable displacement hydraulic pumps to the respective first and second hydraulic actuators. A system controller is included and configured to detect that a pressure in one of the first and second hydraulic circuits exceeds a predetermined safe pressure and to destroke the variable displacement hydraulic pump associated with the overpressure hydraulic circuit such that the pressure in the overpressure hydraulic circuit is reduced to less than the predetermined safe pressure.

Other features and advantages of the described principles will be apparent from the detailed specification, taken in conjunction with the attached drawing figures, of which:

DETAILED DESCRIPTION

Figure 1:
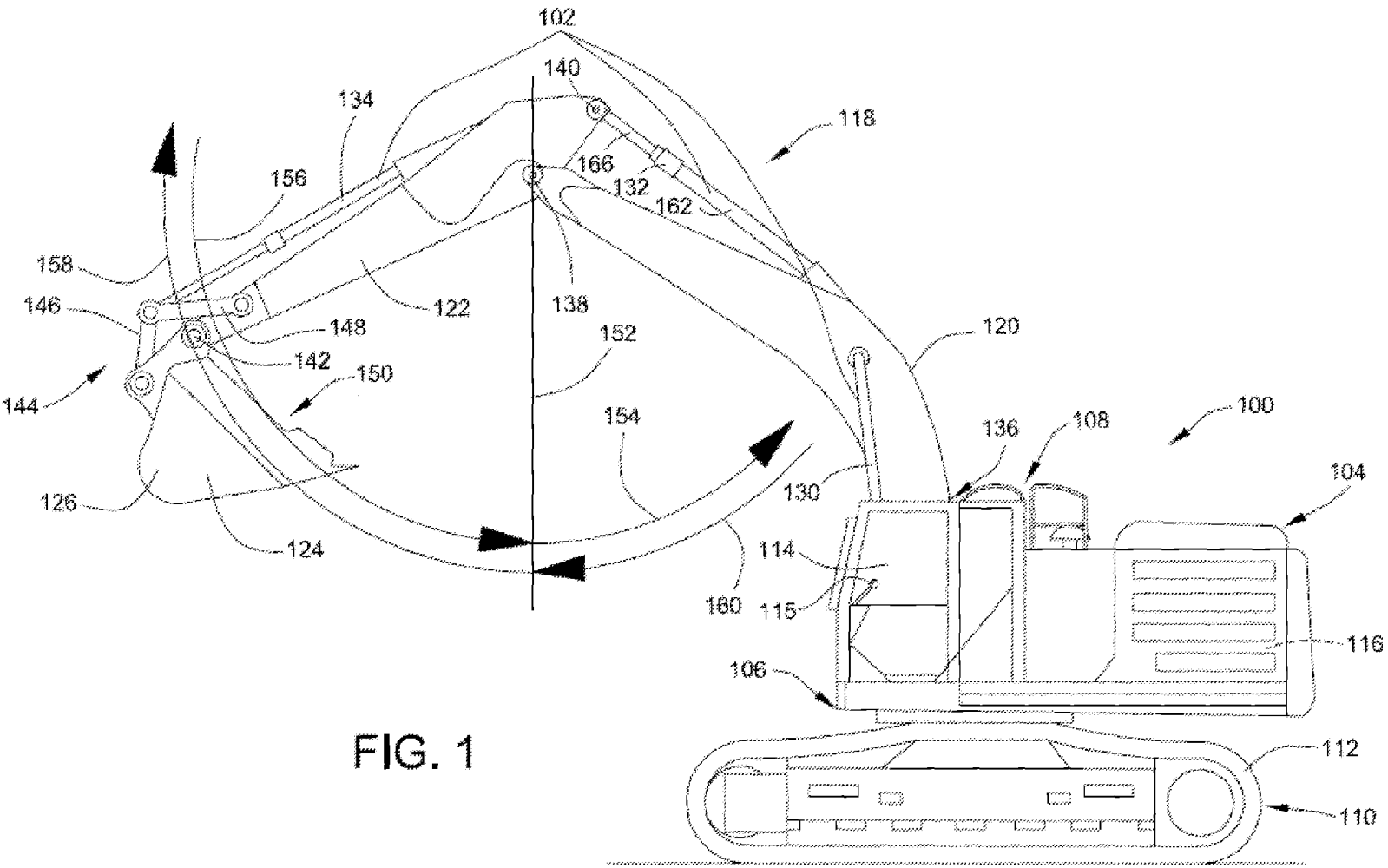
FIG. 1 is a side elevational view of a machine incorporating aspects of this disclosure.

This disclosure relates to machines 100 that utilize hydraulic actuators (identified generally as 102) to control movement of moveable subassemblies of the machine, such as arms, booms, implements, or the like. More specifically, the disclosure relates to such so-called meterless hydraulic systems 104 utilized in machines 100, such as the excavator 106 illustrated in FIG. 1, used to control extension and retraction of such hydraulic actuators 102. While the arrangement is illustrated in connection with an excavator 106, the arrangement disclosed herein has universal applicability in various other types of machines 100 as well. The term "machine" may refer to any machine that performs some type of operation associated with an industry such as mining, construction, farming, transportation, or any other industry known in the art. For example, the machine may be a wheel loader or a skid steer loader. Moreover, one or more implements may be connected to the machine 100. Such implements may be utilized for a variety of tasks, including, for example, brushing, compacting, grading, lifting, loading, plowing, ripping, and include, for example, augers, blades, breakers/hammers, brushes, buckets, compactors, cutters, forked lifting devices, grader bits and end bits, grapples, blades, rippers, scarifiers, shears, snow plows, snow wings, and others.

The excavator 106 of FIG. 1 includes a cab 108 that is swingably supported on an undercarriage 110 that includes a pair of rotatably mounted tracks 112. The cab 108 includes an operator station 114 from which the machine 100 may be controlled. The operator station 114 may include, for example, an operator control 115 for controlling the extension and retraction of the hydraulic actuators 102. The operator control 115 may be of any appropriate design. By way of example only, the operator control 115 may be in the form of joystick, such as illustrated in FIG. 1, a dial, a switch, a lever, a combination of the same, or any other arrangement that provides the operator with a mechanism by which to identify the movement commanded. The operator station 114 may further include controls such as a hydraulic lockout switch 113, or an on/off switch 111.

The cab 108 may further include an engine 116, and at least a portion of the meterless hydraulic system 104. The engine 116 may be an internal combustion engine or any type power source known to one skilled in the art now or in the future.

A front linkage 118 includes a boom 120 that is pivotably supported on the cab 108, a stick 122 pivotably coupled to the boom 120, and an implement 124 pivotably coupled to the stick 122. While the implement 124 is illustrated as a bucket 126, the implement 124 may alternately be, for example, a compactor, a grapple, a multi-processor, thumbs, a rake, a ripper, or shears.

Movement of the boom 120, stick 122, and implement 124 is controlled by a number of actuators 130, 132, 134. The boom 120 is pivotably coupled to cab 108 at one end 136. To control movement of the boom 120 relative to the cab 108, a pair of actuators 130 are provided on either side of the boom 120, coupled at one end to the cab 108, and at the other end to the boom 120.

The stick 122 is pivotably coupled to the boom 120 at a pivot connection 138. Movement of the stick 122 relative to the boom 120 is controlled by the actuator 132 that is coupled at one end to the boom 120, and at the other end to the stick 122. The actuator 132 is pivotably coupled to the stick 122 at a pivot connection 140 that is spaced from the pivot connection 138 such that extension and retraction of the actuator 132 pivots the stick 122 about pivot connection 138.

The implement 124 is pivotably coupled to the stick 122 at pivot connection 142. Movement of the implement 124 relative to the stick 122 is controlled by actuator 134. The actuator 134 is coupled to the stick 122 at one end. The other end of the actuator 134 is coupled to a four-bar linkage arrangement 144 that includes a portion of the stick 122 itself, as well as the implement 124 and a pair of links 146, 148. The actuator 134 is extended in order to move the stick 122 toward the cab (counterclockwise in the illustrated embodiment), and retracted in order to move the implement 124 away from the cab (clockwise in the illustrated embodiment).

Figure 2:
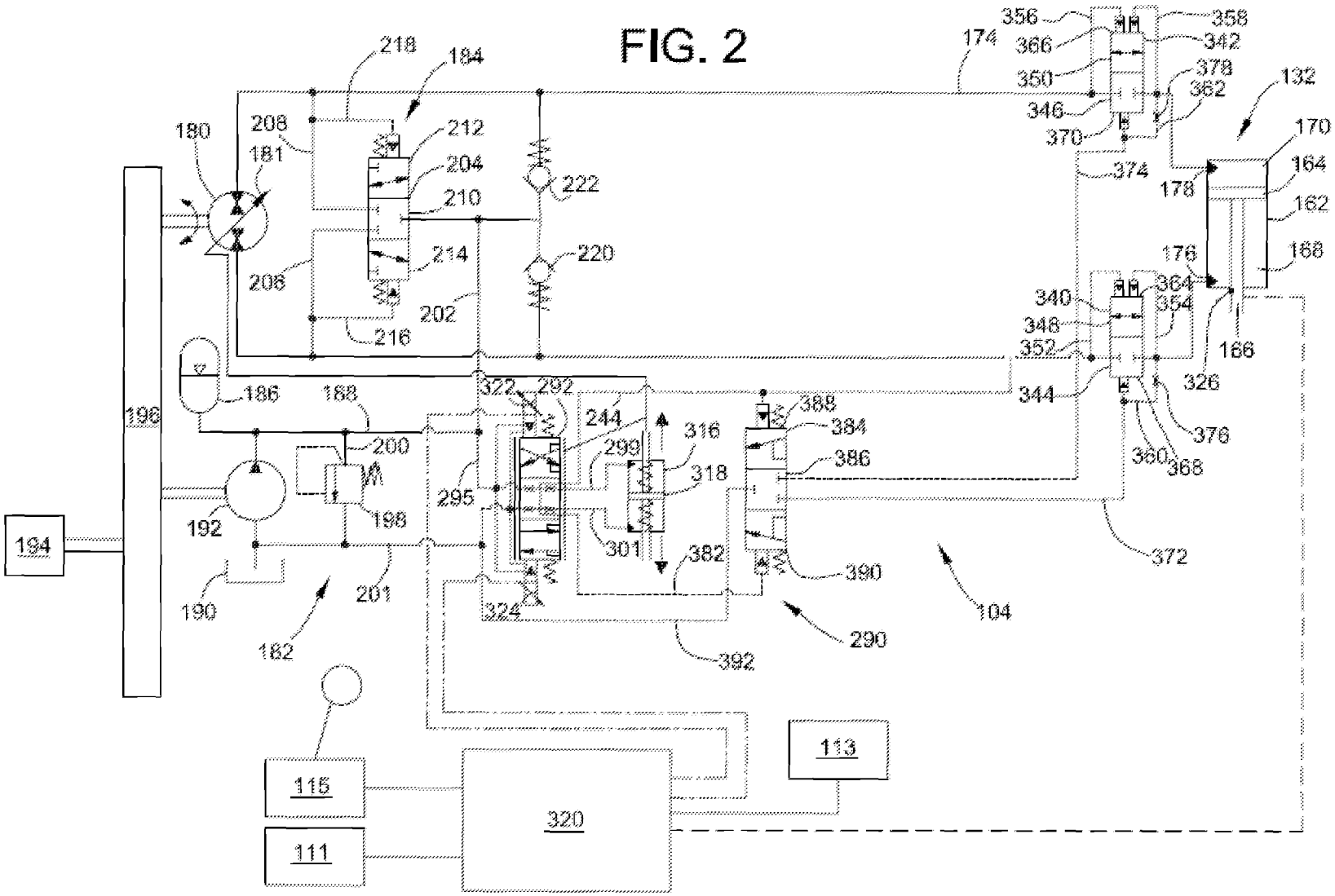
FIG. 2 is a schematic view of a hydraulic system according to this disclosure including a hydraulic Circuit, including multiple actuators, pumps and pressure transducers.

Movement of the actuator 132 is controlled by the meterless hydraulic system 104, which is shown in greater detail in FIG. 2. While the operation of the hydraulic system 104 is explained below with regard to actuator 132, this explanation is equally applicable to the other actuators 130, 134, and other actuator operated by a similar meterless hydraulic system 104.

The actuator 132 includes a cylinder 162 in which a piston 164 is slidably disposed. A rod 166 is secured to the piston 164, and extends from the cylinder 162. In this way, the piston 164 divides the interior of the cylinder 162 into a rod chamber 168 and a cap side chamber 170. In operation, as the actuator 132 is extended, hydraulic fluid flows from the rod chamber 168 and hydraulic fluid flows into the cap side chamber 170 as the piston 164 and rod 166 slide within the cylinder 162 to telescope the rod 166 outward from the actuator 132. Conversely, as the actuator 132 is retracted, hydraulic fluid flows into the rod chamber 168 and hydraulic fluid flows out of the cap side chamber 170 as the piston 164 and rod 166 slide within the cylinder 162 to retract the rod 166 into the cylinder 162. Flow of hydraulic fluid to and from the rod and cap side chambers 168, 170 proceeds through a rod side fluid connection 172 and a cap side fluid connection 174, respectively, that are fluidly coupled to respective ports 176, 178 opening in the rod or cap side chambers 168, 170 in the cylinder 162.

Flow between the rod and cap side chambers 168, 170 through the rod side and cap side fluid connections 172, 174 is provided by a pump 180 wherein the flow rate from the pump may be varied. In this way, the pump 180 controls the operation of actuator 132, rather than so-called metering valves. The illustrated pump 180 is a variable displacement pump 180, which includes a swash plate 181, the angle of which determines the positive or negative displacement of the pump 180, and volume of flow from the pump 180. It will thus be appreciated that the displacement of the pump 180, and, accordingly, the flow rate is controlled in order to control both the direction and volume of the flow of hydraulic fluid to provide extension and retraction of the actuator 132 as commanded by the operator. While a pump 180 is illustrated, the pump 180 may alternately be a fixed displacement pump wherein the speed may be varied by an associated driving motor.

The pump 180 may operate as a pump to positively pump fluid from one fluid connection 172, 174 to the other 172, 174, or a motor as fluid flows from one fluid connection 172, 174 to the other 172, 174. More specifically, as an extension or a retraction of the actuator 132 is commanded against the force of the load 150, as along the arcs identified as 154 or 158, respectively, in FIG. 1, the pump 180 acts as a pump, pumping hydraulic fluid from one chamber 168, 170 to the other 168, 170. Conversely, when an extension or a retraction of the actuator 132 is commanded in the same direction as the force of the load 150, as in the arcs identified as 156 or 160, respectively, in FIG. 1, the force of the load 150 causes a movement of fluid from one chamber 168, 170 to the other 168, 170 such that the energy of fluid motion allows the pump 180 to be operated as a motor.

It will be appreciated by those of skill in the art that the respective volumes of hydraulic fluid flowing into and out of the rod and cap side chambers 168, 170 during extension and refraction of the actuator 132 are not equal. This is a result of the difference in surface area of the piston 164 on the rod and cap side chambers 168, 170; that is, the surface area of the piston 164 where the rod 166 extends from the piston 164 is less than the surface area of the piston 164 facing the cap side chamber 170. Consequently, during retraction of the actuator 132, more hydraulic fluid flows from the cap side chamber 170 than can be utilized in the rod chamber 168. Conversely, during extensions of the actuator 132, additional hydraulic fluid is required to supplement the hydraulic fluid flowing from the rod chamber 168 in order to fill the cap side chamber 170. To receive this excess hydraulic fluid and provide this supplemental hydraulic fluid, a charge circuit 182 and make-up hydraulic circuit 184 are provided, as shown in FIG. 2.

The charge circuit 182 includes at least one hydraulic fluid source, two of which are provided in the illustrated embodiment. The illustrated charge circuit 182 includes an accumulator 186 that may be utilized to provide a source of pressurized hydraulic fluid or that may be charged with excess hydraulic fluid through a charge conduit 188. The illustrated charge circuit 182 additionally includes a tank 190 from which hydraulic fluid may be provided by a second pump 192 through the charge conduit 188. Excess hydraulic fluid, either from the second pump 192 or operation of the actuator 132 may be returned to either the accumulator 186, or to the tank 190 by way of a charge pilot valve 198 disposed in a charge pilot conduit 200, which is fluidly connected to return conduit 201. The charge pilot valve 198 is operated as a result of fluid pressure in the conduit 200 along the inlet side of the charge pilot valve 198, although an alternate method of operation may be provided. In this embodiment, the pump 180 and the second pump 192 are both operated by a prime mover 194, such as the engine 116, through a gearbox 196. In an alternate embodiment, one or both of the pumps 180, 192 may connected directly to the engine 116 or prime mover 194 shaft with no speed ratio change. The pump 180 and/or the second pump 192 may alternately be operated by a battery or other power storage arrangement. It will further be appreciated that the second pump 192 may be selectively operated, or continuously operated, as in the illustrated embodiment, depending upon the arrangement provided.

The make-up hydraulic circuit 184 includes a make-up conduit 202 that is fluidly coupled to the charge conduit 188, a make-up valve 204, a rod side make-up conduit 206 and a cap side make-up conduit 208, which are fluidly coupled to the rod side fluid connection 172 and the cap side fluid connection 174, respectively. The make-up valve has three positions. The first, central default position 210 prevents flow to or from each of conduits 202, 206, 208. Alternatively, the central default position may be constructed such that conduit 208 is connected to conduit 202 by an orifice (not shown), and conduit 206 is connected to conduit 202 by an orifice (not shown); this connection using orifices may be desirable if the pump 180 does not return to a perfect zero displacement when commanded to neutral.

For the purposes of this disclosure, however, any reference to the central default position 210 being considered a no-flow position is intended to include both illustrated design wherein no connections is made, and a situation wherein orifices are disposed between the conduits 208, 206 and the conduit 202 to severely limit any flow therethrough. The second position 212 fluidly couples the make-up conduit 202 and the rod side make-up conduit 206 to allow flow therethrough, and prevent flow to or from the cap side make-up conduit 208. The third position 214 fluidly couples the make-up conduit 202 and the cap side make-up conduit 208 to allow flow therethrough, and prevent flow to or from the rod side make-up conduit 206.

In order to operate the make-up valve 204, pilot connections 216, 218 are provided from the rod and cap side make-up conduits 206, 208, respectively. Thus, the make-up valve 204 is operative as a result of a minimum pressure differential between the pilot connections 216, 218. While very little flow occurs through the pilot connections 216, 218, it will be appreciated that the pressure from the rod side fluid connection 172 is applied to the pilot connection 216 by way of the rod side make-up conduit 206. Similarly, the pressure from the cap side fluid connection 174 is applied to the pilot connection 218 by way of the cap side make-up conduit 208.

When the pressure on the cap side pilot connection 218 is sufficiently greater than the pressure on the rod side pilot connection 216, the make-up valve 204 will move to its second position 212. Conversely, when the pressure on the rod side pilot connections 216 is sufficiently greater than the pressure on the cap side pilot connection 218, the make-up valve 204 will move to its third position 214.

It will be noted that the make-up circuit 184 may include additional valving arrangements. By way of example, the make-up circuit 184 may include check valves 220, 222 that are operative at set pressure differentials between the make-up conduit 202 and the rod side and cap side fluid connections 172, 174, respectively. It will be appreciated that the check valves 220, 222 will unseat to permit flow if the pressure within the make-up conduit 202 is sufficiently greater than the pressures in rod side and cap side fluid connections 172, 174, respectively. The check valves 220, 222 may include any device for limiting flow in a piping system to a single direction known by one skilled in the art now and in the future.

Figure 3:
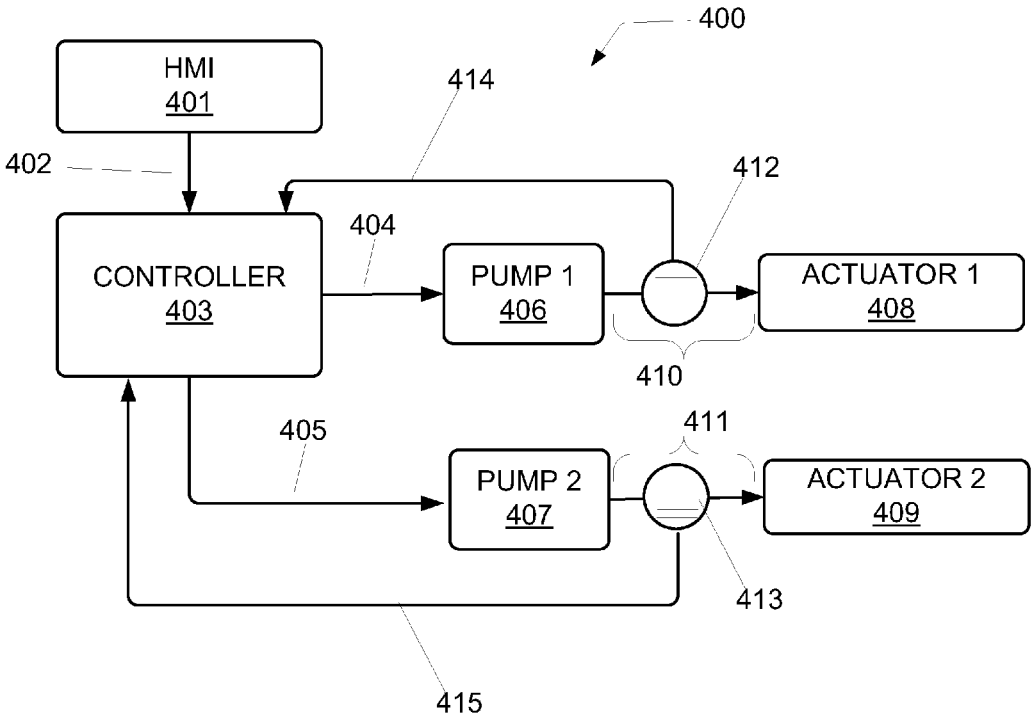
FIG. 3 is a schematic control architecture view of the pump displacement control of FIG. 2 including data and command signaling.

Turning now to FIG. 3, this figure is a schematic view of the control architecture 400 of the pump displacement control of FIG. 2 including data and command signaling. In particular, the illustrated control architecture 400 includes a human machine interface (HMI) 401 which allows the machine to receive operator commands and translate them into a machine operable form such as a digital or analog command or signal. Examples of the HMI 401 include the related structures of FIG. 1, namely operator control 115 for controlling the extension and retraction of the hydraulic actuators 102, which control may be in the form of a joystick, a dial, a switch, a lever, a combination of the same, or any other arrangement by which the operator may command a movement, as well as a hydraulic lockout switch 113, on/off switch 111, etc.

In addition to the HMI 401, the architecture 400 includes a controller 403 for receiving an interface command 402 from the HMI 401. The controller 403 may comprise one or more processors, e.g., microprocessors, for generating and transmitting control signals 404, 405 based on received data and commands. The controller 403 may operate specifically by the computerized execution of computer-readable instructions stored on a nontransitory computer-readable medium such as a RAM, ROM, PROM, EPROM, optical disk, flash drive, thumb drive, etc.

The controller 403 is operable to receive commands and data from the HMI 401 and to receive pressure data from another source, to be discussed, and control a pump flow on that basis. In particular, the commands 404, 405 output from the controller 403 are provided to a first hydraulic pump 406 and to a second hydraulic pump 407 respectively. Each of the first hydraulic pump 406 and the second hydraulic pump 407 is configured to provide pressurized fluid at a commanded rate. The first hydraulic pump 406 is fluidly linked via hydraulic circuit 410 to supply pressurized fluid to a first hydraulic actuator 408, while the second hydraulic pump 407 is fluidly linked via hydraulic circuit 411 to supply pressurized fluid to a second hydraulic actuator 409. As discussed above, the hydraulic actuators 408, 409 may be situated to power various machine functions depending upon the type of machine being operated.

Depending upon the ease with which each actuator moves, i.e., in an encumbered on unencumbered manner, the pressure within each hydraulic circuit 410, 411 will vary over time. While some pressure variation is thus to be expected, an excessive rise in pressure, e.g., due to striking an obstacle with the associated operated implement or function, may severely damage the hydraulic actuator, the associated hydraulic circuit, and/or the associated hydraulic pump. While it is known to use simple pressure relief valves to buffer such pressure spikes, this technique, while simple, has certain drawbacks. For example, the release of pressurized fluid through a relief valve has the affect of dumping energy out of the system and thus lowering fuel efficiency.

Thus, the disclosed principles allow a meterless hydraulic supply system that operates in the absence of a pressure relief valve. In an embodiment, this is accomplished by reducing the pressure in the affected hydraulic circuit by lossless means. In particular, each hydraulic circuit 410, 411 embodies a dedicated pressure sensor 412, 413, which may be a pressure transducer of other mechanism, for sensing a pressure and outputting a signal repeatably related to the sensed pressure.

Each pressure sensor 412, 413 senses a pressure in the associated hydraulic circuit 410, 411, and provides a respective pressure signal 414, 415 to the controller 403, from which the controller 403 is able to identify the existence and extent of any over-pressure condition in the associated circuit 410, 411. Thus, for example, the signal from each pressure sensor 412, 413 may be an analog or digital representation of the hydraulic pressure in the associated hydraulic circuit 410, 411.

As will be discussed in greater detail hereinafter, the controller 403 responds to the received pressure signals 414, 415 by modifying one or both of the pressure commands 404, 405 under certain circumstances to eliminate a circuit overpressure condition. In particular, the quantitative behavior of the system during a pressure spike will be discussed with reference to FIG. 4, and then the operations of the controller 403 to alleviate pressure spikes will be discussed with reference to FIG. 5.

Figure 4:
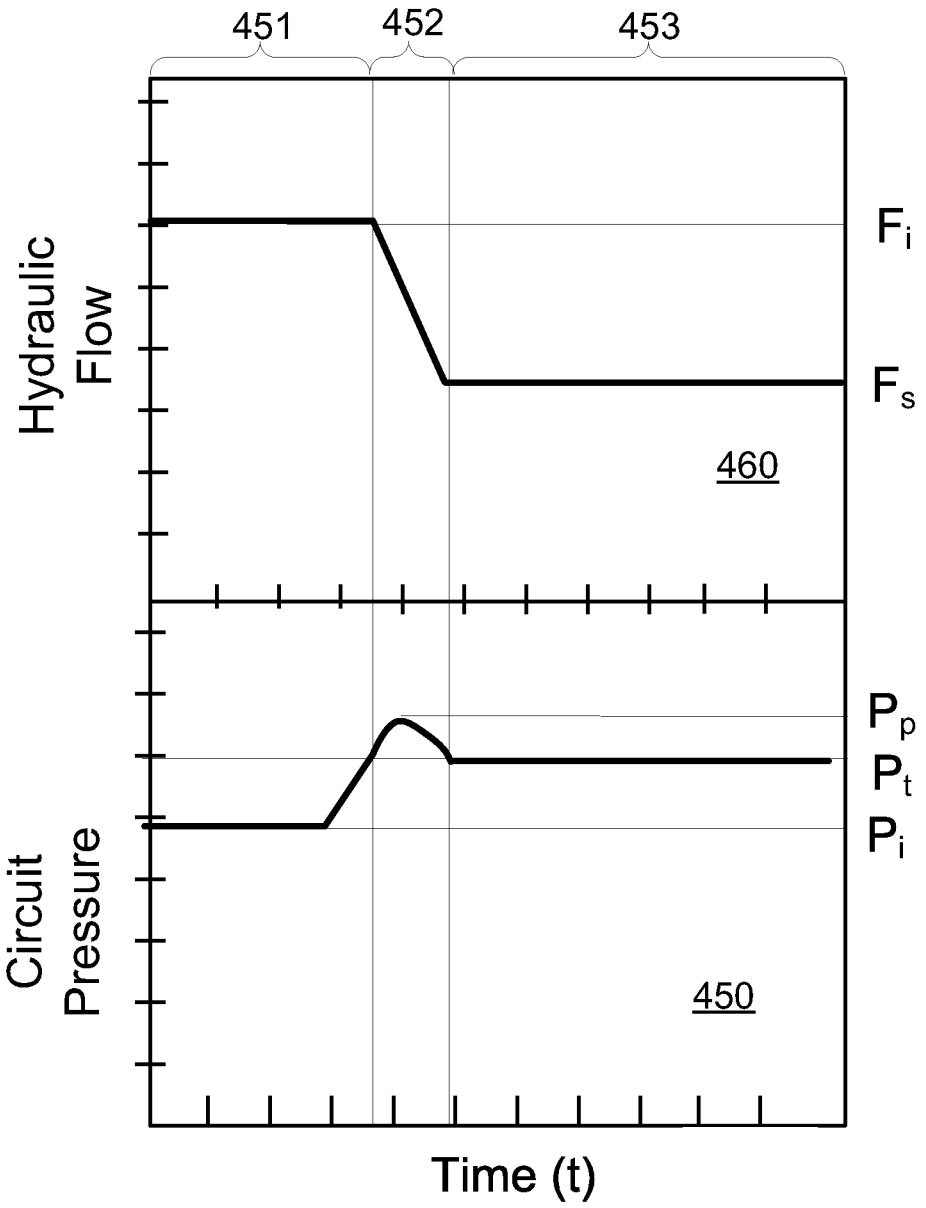
FIG. 4 is a simplified plot showing a hydraulic circuit pressure spike and correlated displacement reduction according to the disclosure.

Thus, turning now to FIG. 4, this figure illustrates a set of simplified plots showing a hydraulic circuit pressure spike and correlated displacement reduction according to an embodiment of the disclosure. The bottom curve 450 plots hydraulic pressure in one hydraulic circuit of interest as a function of elapsed time. This plot 450 represents the pressure signal received from an appropriate pressure sensor associated with the hydraulic circuit.

The plot illustrates three regions, namely an initial normal region 451, a high-pressure spike region 452, and a subsequent normal pressure region 453. The top plot 460 illustrates the progression of circuit flow rate, i.e., pump flow rate, during the same periods. As can be seen from the plots 450, 460, the initial system pressure during the initial period 451 is $P_i$, with an associated hydraulic flow of $F_i$. As time progresses, an obstacle or other hindrance slows the actuator, increasing hydraulic pressure, without changing the hydraulic flow. During this period, the hydraulic pressure increase, but is beneath an overpressure threshold $P_t$. However, in time, as the hydraulic pressure continues to increase, it passes the overpressure threshold $P_t$ at the start of high-pressure spike region 452.

Once the hydraulic pressure has passed the overpressure threshold $P_t$, the controller 403 reacts by decreasing the hydraulic flow, as can be seen in plot 451 during high-pressure spike region 452. Initially, the decrease in hydraulic flow does not reduce the hydraulic pressure to below the overpressure threshold $P_t$, and indeed the hydraulic pressure reaches its peak $P_p$ during this period. However, eventually, the decrease in hydraulic flow reverses the pressure spike, and the hydraulic pressure falls to or below the overpressure threshold $P_t$ at the start of subsequent normal pressure region 453. Throughout this region 453, the hydraulic pressure remains stable at $P_t$ and the hydraulic flow remains stable at $F_s$.

Figure 5:
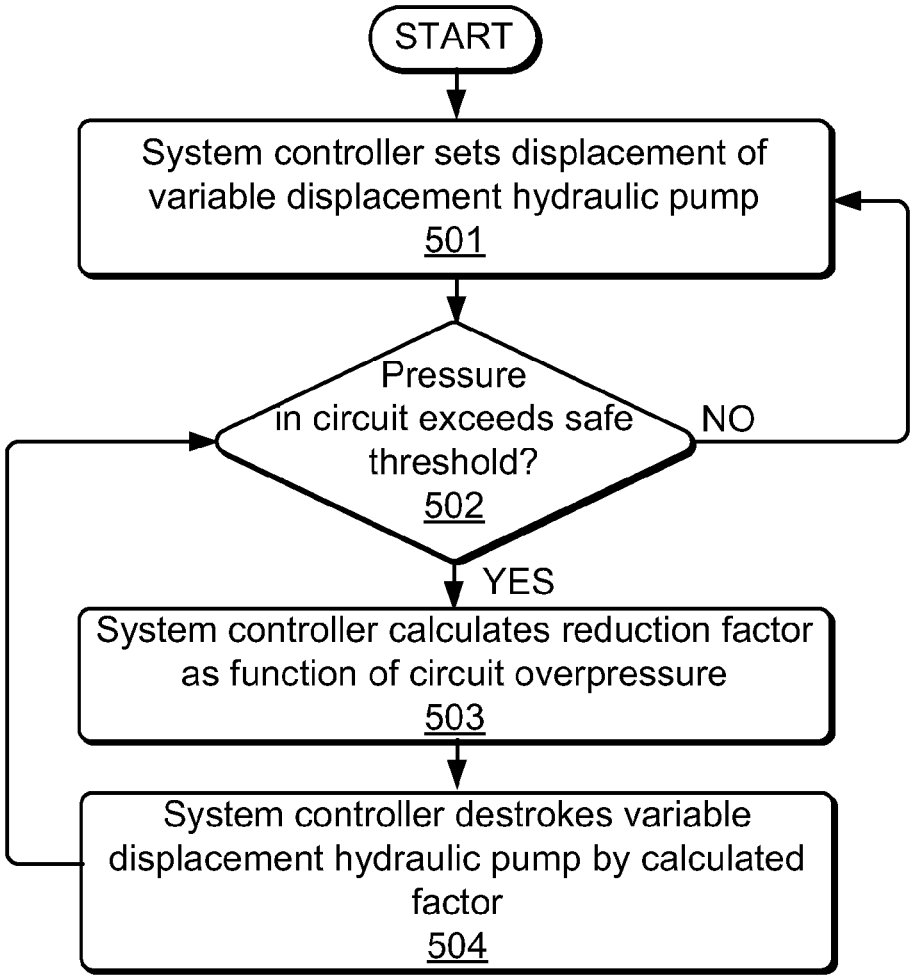
FIG. 5 is a flow chart of a process for applying a flow reduction as described herein to alleviate an overpressure condition in a meterless hydraulic circuit such as that shown herein.

The controller function that provides this pressure-ameliorating behavior will be discussed in greater detail with respect to the flow chart of FIG. 5. In particular, FIG. 5 is a flow chart of a process 500 for applying a flow reduction as described herein to alleviate an overpressure condition in a meterless hydraulic circuit such as that shown above. At stage 501 of process 500, the controller 403 establishes an initial flow rate based on a user command and/or automated response. In the case wherein the hydraulic pump is a variable displacement hydraulic pump, the controller sets the flow of the variable displacement hydraulic pump by setting the angle of a swash plate associated with the variable displacement hydraulic pump. In an alternative embodiment wherein the hydraulic pump is a fixed displacement electrically-driven hydraulic pump, the controller sets the flow of the fixed displacement electrically-driven hydraulic pump by setting a speed of the associated electric drive mechanism (not shown) such as an electric motor.

As the process 500 continues, the controller 403 monitors the pressure signal received from the pressure sensor associated with the hydraulic circuit being measured at stage 502. It will be appreciated that the illustrated process 500 is executed in parallel for each monitored circuit. If the monitored pressure has not exceeded a predetermined limit, e.g., the overpressure threshold $P_t$, then the process 500 continues from stage 502 back to stage 501 to execute any changes in commanded flow.

If, however, it is determined at stage 502 that the monitored pressure has exceeded the predetermined limit, the process 500 branches to stage 503, wherein the controller 403 calculates a reduction factor for the hydraulic flow. In an embodiment, in order to provide a smooth but sufficiently rapid reduction in pressure, the reduction factor is related to extent to which the hydraulic pressure has exceeded the predetermined limit, and in a further embodiment is proportional to the extent to which the hydraulic pressure has exceeded the predetermined limit. Thus, for example, if the circuit pressure has gone from below the predetermined limit to 50% beyond the limit in one checking interval, the reduction factor would be much greater than if during the same interval the pressure had risen to only 20% beyond the limit.

Having calculated the reduction factor, the controller applies the reduction factor in stage 504 to reduce the circuit pressure. In the case of a variable displacement hydraulic pump, the pump swash plate may be destroked by an amount set by the reduction factor. In an alternative embodiment, if a fixed displacement electrically-driven hydraulic pump is used, the pump speed may be decreased by the reduction factor. The reduction factor may be in any suitable form, i.e., multiplicative, subtractive, etc. After the reduction factor is applied and the flow reduced, the process returns to stage 501 to apply any updated control commands.

INDUSTRIAL APPLICABILITY

The described system and method may be applicable to any meterless hydraulically actuated machine having one or more variable flow pumps, e.g., excavators, motorgraders, dozers, etc. The described system and method may avoid the use of pressure relief valves, which tend to waste energy when triggered. The described system may also allow a temporary increase in pressure where such may be beneficial without being damaging, whereas relief valve systems open as soon as the limit pressure is reached.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A method for overpressure control in a hydraulic system having multiple hydraulic pumps, each hydraulic pump being connected by a respective hydraulic circuit for actuating a single respective hydraulic actuator, the method comprising;

actuating, at a first flow rate, a first variable displacement hydraulic pump of the multiple hydraulic pumps, the first hydraulic pump being fluidly linked by a first hydraulic circuit to a first hydraulic actuator for powering the first hydraulic actuator;

detecting a first pressure in the first hydraulic circuit, the first pressure being below a predetermined threshold pressure;

subsequently detecting a second pressure in the first hydraulic circuit, the second pressure exceeding the predetermined threshold pressure; and electronically modifying the flow rate of the first hydraulic pump to a second flow rate lower than the first flow rate whereby the pressure in the first hydraulic circuit is reduced to a pressure that is below the predetermined threshold pressure, wherein the detecting a second pressure in the first hydraulic circuit exceeding the predetermined threshold pressure is preceded by encountering an obstacle to movement of the first hydraulic actuator, thereby raising the pressure in the first hydraulic circuit.

2. The method for overpressure control in a hydraulic system according to claim 1, wherein each of the multiple hydraulic pumps is a variable displacement hydraulic pump.

3. The method for overpressure control in a hydraulic system according to claim 2, wherein electronically modifying the flow rate of the first hydraulic pump to a second flow rate lower than the first flow rate comprises modifying a displacement of the first hydraulic pump from a first displacement level to a second displacement level lower than the first displacement level.

4. The method for overpressure control in a hydraulic system according to claim 1, wherein each of the multiple hydraulic pumps is an electrically driven variable flow hydraulic pump.

5. The method for overpressure control in a hydraulic system according to claim 4, wherein electronically modifying the flow rate of the first hydraulic pump to a second flow rate lower than the first flow rate comprises modifying a driven speed of the first hydraulic pump from a first driven speed to a second driven speed less than the first driven speed.

6. The method for overpressure control in a hydraulic system according to claim 1, wherein each of the multiple hydraulic actuators powers a separate movable element of a machine.

7. The method for overpressure control in a hydraulic system according to claim 6, wherein the separate movable elements of the machine include a boom, a bucket, and a swing function.

8. The method for overpressure control in a hydraulic system according to claim 2, further including:

actuating a second variable displacement hydraulic pump of the multiple variable displacement hydraulic pumps, the second variable displacement hydraulic pump being fluidly linked by a second hydraulic circuit to a second hydraulic actuator for powering the second hydraulic actuator; and leaving the displacement of the second variable displacement hydraulic pump fixed while electronically modifying the displacement of the first variable displacement hydraulic pump, from the first displacement level to the second displacement level.

9. The method for overpressure control in a hydraulic system according to claim 1, wherein the first hydraulic circuit is configured to operate in the absence of a relief valve.

10. The method for overpressure control in a hydraulic system according to claim 3, wherein the displacement of each variable displacement hydraulic pump is controlled by a respective swash plate having a swash plate angle, and wherein electronically modifying the displacement of the first variable displacement hydraulic pump comprises electronically altering the swashplate angle of the swash plate associated with the first variable displacement hydraulic pump.

11. The method for overpressure control in a hydraulic system according to claim 10, wherein the swash plate associated with the first variable displacement hydraulic pump is controlled by a hydraulic actuator controlled by an electronic solenoid valve, and wherein electronically altering the swashplate angle of the swash plate associated with the first variable displacement hydraulic pump includes controlling the electronic solenoid valve.

12. The method for overpressure control in a hydraulic system according to claim 1, wherein each hydraulic circuit includes a pressure transducer, and wherein each of the steps of detecting a first pressure and detecting a second pressure includes receiving a pressure indicative signal from the pressure transducer associated with the first hydraulic circuit.

13. The method for overpressure control in a hydraulic system according to claim 3, wherein electronically modifying the displacement of the first variable displacement hydraulic pump, from the first displacement level to a second displacement level lower than the first displacement level includes destroking the first variable displacement hydraulic pump by a factor that is a function of the pressure indicative signal associated with the first pressure.

* * * * *

UNITED STATES PATENT AND TRADEMARK OFFICE

CERTIFICATE OF CORRECTION

PATENT NO. : 8,887,499 B2
APPLICATION NO. : 13/172320
DATED : November 18, 2014
INVENTOR(S) : Edler et al.

It is certified that error appears in the above-identified patent and that said Letters Patent is hereby corrected as shown below:

On the title page, item 56

Column 2, (Other Publications), line 4, delete "DIsplacement" and insert -- Displacement --.

Column 2, (Other Publications), line 11, delete "retreived" and insert -- retrieved --.

In the specification

Column 4, line 40, delete "refraction" and insert -- retraction --.

Signed and Sealed this
Seventeenth Day of November, 2015

Michelle K. Lee

Michelle K. Lee
*Director of the United States Patent and Trademark Office*